US012582223B2

(12) United States Patent
Cutler

(10) Patent No.: US 12,582,223 B2
(45) Date of Patent: Mar. 24, 2026

(54) APPLICATOR FOR APPLYING FLOWABLE MATERIALS

(71) Applicant: Amy Cutler, Draper, UT (US)

(72) Inventor: Amy Cutler, Draper, UT (US)

(73) Assignee: iAMBE Products LLC, Draper, UT (US)

( * ) Notice: Subject to any disclaimer, the term of this patent is extended or adjusted under 35 U.S.C. 154(b) by 0 days.

(21) Appl. No.: 18/336,980

(22) Filed: Jun. 17, 2023

(65) Prior Publication Data

US 2024/0032682 A1 Feb. 1, 2024

Related U.S. Application Data

(60) Provisional application No. 63/435,239, filed on Dec. 24, 2022, provisional application No. 63/393,227, filed on Jul. 28, 2022.

(51) Int. Cl.
*A46B 11/00* (2006.01)
*A46B 9/00* (2006.01)

(52) U.S. Cl.
CPC ..... *A46B 11/0089* (2013.01); *A46B 9/005* (2013.01); *A46B 11/0041* (2013.01); *A46B 11/0086* (2013.01); *A46B 2200/1046* (2013.01)

(58) Field of Classification Search
CPC ..... A45D 34/042; A45D 40/262; A46B 11/0089; A46B 9/005; A46B 11/0041; A46B 2200/1046; A46B 11/00; A46B 11/001; A46B 11/002; A46B 11/0075; A46B 11/0079; A46B 11/0086
USPC ..... 401/270, 277, 280, 281, 282, 284, 265, 401/266
See application file for complete search history.

(56) References Cited

U.S. PATENT DOCUMENTS

| | | | | |
|---|---|---|---|---|
| 1,010,324 | A | 11/1911 | Sparks | |
| 1,773,820 | A * | 8/1930 | Lysons | B65D 35/36 222/548 |
| 6,702,733 | B1 | 3/2004 | Thompson | |
| D512,647 | S | 12/2005 | Py | |
| 7,086,796 | B2 | 8/2006 | Severa | |
| 7,101,107 | B1 | 9/2006 | Byun | |
| 7,229,229 | B2 * | 6/2007 | Wang | B05B 11/047 401/262 |
| D558,920 | S | 1/2008 | Sheppard | |
| D567,509 | S | 4/2008 | Kao | |
| 7,416,360 | B2 * | 8/2008 | Tajima | B43K 8/022 401/269 |
| D654,792 | S | 2/2012 | Bertelsen | |
| 8,226,319 | B2 | 7/2012 | Francavilla et al. | |
| 9,247,805 | B1 | 2/2016 | Malm | |
| D850,116 | S | 6/2019 | Schmidt | |

(Continued)

FOREIGN PATENT DOCUMENTS

DE 19811552 9/1999

OTHER PUBLICATIONS

International Search Report, PCT/US2023/027850, Oct. 3, 2020.

(Continued)

*Primary Examiner* — David J Walczak
(74) *Attorney, Agent, or Firm* — BATEMAN IP; Randall B. Bateman

(57) ABSTRACT

An applicator for applying flowable materials fluid such as a cream, lotion, serum, gel, and powders having a reservoir and a brush for applying the flowable material.

21 Claims, 10 Drawing Sheets

(56) References Cited

U.S. PATENT DOCUMENTS

| | | | | |
|---|---|---|---|---|
| D908,955 | S | 1/2021 | Gautier | |
| 11,154,126 | B1 | 10/2021 | Zheng et al. | |
| D957,137 | S | 7/2022 | Gooden | |
| D981,247 | S | 3/2023 | Chung | |
| D984,046 | S | 4/2023 | Sherear | |
| D990,784 | S | 6/2023 | Kim | |
| D999,059 | S | 9/2023 | Tidwell | |
| 2008/0286034 | A1* | 11/2008 | Chu | A45D 34/042 401/268 |
| 2008/0317544 | A1 | 12/2008 | Spirk et al. | |
| 2009/0311034 | A1 | 12/2009 | Pires et al. | |
| 2011/0259359 | A1 | 10/2011 | Groh et al. | |
| 2012/0093567 | A1 | 4/2012 | Kravchenko | |
| 2012/0207531 | A1 | 8/2012 | Rusev | |
| 2016/0279653 | A1 | 9/2016 | Brugger | |
| 2019/0255305 | A1 | 8/2019 | Hendriks et al. | |
| 2021/0316914 | A1 | 10/2021 | Tidwell | |
| 2022/0232946 | A1 | 7/2022 | Cui | |

OTHER PUBLICATIONS

Written Opinion, PCT/US2023/027850, Oct. 3, 2023.
International Preliminary Examination report, PCT/US2023/027850, Sep. 4, 2024.
Lotrimin Ultra® Athlete's Foot Cream with No Touch Applicator website—Exact date unknown, Approximate date 2022.

* cited by examiner

APPLICATOR FOR APPLYING FLOWABLE MATERIALS

RELATED APPLICATIONS

The present application claims the benefit of U.S. Provision Patent Application No. 63/393,227, Filed Jul. 28, 2022 and Provisional Patent Application No. 63/435,239, filed Dec. 24, 2022.

BACKGROUND

State of the Art

The present disclosure relates to applicators for applying flowable materials. In particular, the present disclosure relates to novel applicators and methods of using the same to apply flowable material to a variety of surfaces. Representative flowable materials may include creams, serums, liquids and gels may include personal care products, such as skin creams, serums, liquids and gels for pre-facials, post laser hair removal, warts, stretchmarks, face cleanser, anti-aging, blackheads, masks, hydrocortisone, skin bleaches, sunscreen, body oil, skin lightener/brightener, skin primer, post sunburn, insect repellent, under eye foundation, other makeup, aloe vera, lip corrector, hemorrhoids, skin tightener, pain relievers, anti-cramping, calamine, dark spot treatments, skin glow, steroids, moisturizer, eczema/rash medications, vulva or vaginal deodorants and anti-perspirants, shampoo post facial skin care, anti-fungals, penal/erection treatments, medicine, chemical peels, anti-ringworm, yeast infections, microdermabrasion, cold sore treatments, skin tag/mole treatments, body butters/lotions, creams, aesthetician support and practice creams, anti-itch medications, grease removers, skin coloring, hair coloring/developer, baby lotions and care creams, acne treatments, heal softeners, shaving creams and aftershave, professional hair products, callus removal, hair removal, hair defrizz, diaper rash, bunion treatments, post wax treatments, hair conditioner, ingrown toenail treatments, scalp treatments, nail fungal treatments, dandruff treatments, cuticle/cuticle dead-end treatments, sealants, hair straightener, beard oils, denture cream, tattoo creams and CBD/THC oils.

There are a variety of situations in which a person applies a cream, serum liquid, lotion, or gel to their body. In particular with women, there are a variety of situations in which various liquids or creams or other flowable material are replied to the labium majora, labium minora or clitoris or Bartholin glands. For example, anti-itch creams may be applied to the labium minora when a woman is suffering from a yeast infection or other irritation. Likewise, personal lubricant may be applied to the labium majora, clitoris and/or Bartholin glands when needed.

Similarly, there are numerous times when various creams or liquids are applied to another person's body. For example, a young child may have diaper rash, or an older child may have developed a rash due to contact with an irritant, such as poison ivy. While various creams or ointments need to be applied to the rash or other skin condition, touching with affected area with a bare finger may increase the risk of transmission between both people. Thus, it is desirable to enable the convenient application of creams, ointments and the like while not requiring contact between the two individuals.

The manner of applying various creams, serums, lotions, and other flowable materials. Sometimes the fluid material is placed on the person's finger and then applied. In other situations, it is disposed on toilet paper or some other disposable product and applied. The use of one's finger, however, is not hygienic and can risk the transmission of disease either to or from the area surrounding the vagina. Additionally, the use of toilet paper or other disposables often makes it hard to apply the flowable material to the desired location without also applying it to other locations where it may not be desired.

These concerns are also present if someone is applying a topical treatment to a cut or sore—with the risk of the person's unwashed hands potentially contaminating the wound. Similarly, a person wishing to apply foundation to his or her skin to cover a blemish may not want to get the material on his or her hand, where it may be accidentally transferred to a shirt or other clothing. Thus, it would be desirable to provide an applicator which can apply flowable material to the skin while keeping the hands of the person applying the material from coming into contact with the material.

Representative flowable materials may also include various food products. A person cooking may wish to apply marinade, sauces or oils to a piece of meat, fruit or vegetables or other food. For example, a person barbequing meat may wish to apply barbecue sauce to a piece of meat each time it is turned. A person may wish to apply liquid butter to a piece of corn on the cob, or a person may wish to apply an oil and vinegar mixture to some vegetables on a platter while not applying the same mixture to other vegetables on the same platter.

Representative flowable materials may include paints, stains, glues, lubricants, solvents and strippers for various applications. For example, it is commonplace for a person who paints a building to purchase a small can of paint in the same color to allow the person to touch up scuff marks or other damage to painted surfaces. Once the can is opened, however, the paint is exposed to air and can begin to set, thereby eventually making the rest of the paint unusable. Additionally, the paint brush which is used will often have to be discarded as paint dries in the bristles.

Similarly, applying lubricants, strippers, solvents and other materials can be a challenge. Flowable lubricants may include liquid lubricants to powdered lubricants which are sufficiently fine. It would be beneficial to make such lubricants easier to use, such as, for example having an applicator which makes it easier to apply the lubricant, stripper, solvent, etc., to a particular portion of a part without getting the material on adjacent structures where it may not be desired.

Thus, there is a need for novel applicators for applying flowable material in a variety of applications.

SUMMARY OF THE DISCLOSURE

The following summary of the present disclosure is not intended to describe each illustrated embodiment or every possible implementation of the invention, but rather to give illustrative examples of application of principles of the invention.

In accordance with one aspect of the present disclosure, an applicator is provided with a reservoir for holding a flowable material such as cream, serum, liquid, lotion, gel or fine powder. The applicator may include a brush cap with a contoured brush head which is customized to a desired application of the flowable material.

In accordance with one aspect of the present disclosure, the flowable material may be a cream, lotion or ointment to be applied in the vaginal area. The applicator may include a brush cap with a contoured brush head which can fit between the labium majora. The brush cap may be attached to a collapsible container which may be squeezed to dispense the cream, lotion, ointment, etc.

In accordance with one aspect of the present disclosure, the applicator may include a reservoir for holding cream, lotion, ointment, etc., to be applied to a user's skin and a brush cap which is configured for the desired application of the cream, lotion, ointment, etc. to a person's body or to another surface.

In accordance with another aspect of the present disclosure, the applicator may include a reservoir containing a flowable foodstuff, such as a sauce, an oil, a marinade or the like and the brush cap being usable to spread the foodstuff on food.

In accordance with another aspect of the present disclosure, the applicator may include a reservoir containing paint or stain and a brush cap which may be used for applying the paint or stain to a wall or other substrate while keeping the paint in the reservoir free from contact with air to prevent the paint or stain from curing or drying.

In accordance with another aspect of the present disclosure, the applicator may include a reservoir containing lubricants, strippers or solvents.

In accordance with another aspect of the present disclosure the brush cap may include a selectively closeable valve to selectively prevent the dispensing of liquid, etc. through the brush cap.

In accordance with another aspect of the present disclosure, the brush cap may include a single piece brush made from a piece or plastic, polymer or silicone. The single piece brush may have one or more holes formed therein to allow the flowable material to flow through the brush. Additionally, the single piece brush my be contoured to facilitate application of a particular flowable material. For example, a single piece brush designed for use on a container containing eye crème may have a concave curvature to match the curvature of a user's skin on the eyelid. Likewise, the single piece brush may include holes for applying the flowable material to multiple places at once. For example, a reservoir having diaper rash ointment may include a channel with two openings to facilitate application of the ointment to both sides of a baby's bottom adjacent the anus, thereby allowing the application of the ointment with a single pass.

In accordance with another aspect of the present disclosure, the brush cap may include an elliptical outflow channel in the brush cap for dispensing lotion, gel, etc., into the brush. Alternatively, the brush cap may include a manifold for dispensing lotion to different locations in the brush to provide a more even distribution.

It will be appreciated that various aspects of the disclosure may be discussed together but are not required to carry out the invention as taught herein. The appended claims are intended to define the invention.

BRIEF DESCRIPTION OF THE DRAWINGS

Various embodiments of the present disclosure are shown and described in reference to the numbered drawings wherein.

Figure 1:
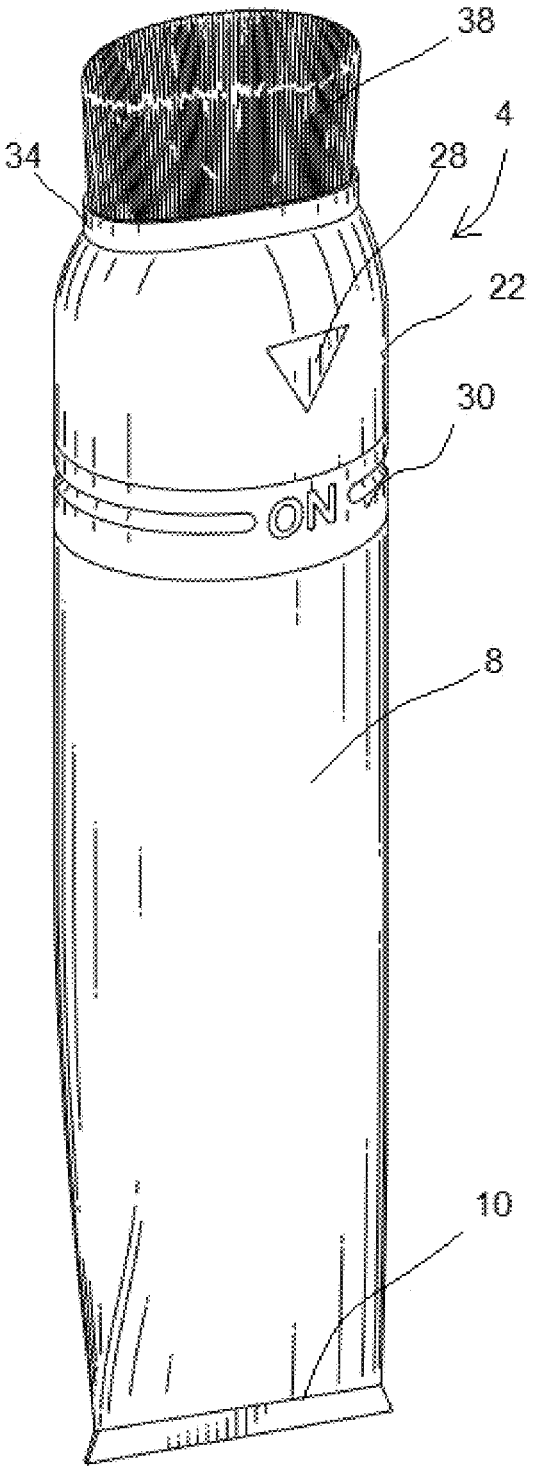
FIG. 1 illustrates perspective view of the applicator for applying creams, serums, liquids, and gels.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment. Rather, the element may be included in other, or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such an aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without necessarily being exactly that quality. For example, a structure said to be generally vertical would be at least as vertical as horizontal, i.e., would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range, or the characteristics being described.

Turning now to FIG. 1, there is shown a perspective view of an applicator, generally indicated at 4. The applicator may include a fluid reservoir 8 which may be formed from a squeezable tube made from a flexible material such as polyethylene or plastic-coated aluminum or other materials. (As used herein, fluid reservoir is intended to hold a flowable material, including flowable powders and the like and should not be confined to a reservoir holding liquid or gas). The lower end 10 of the fluid reservoir 8 is typically sealed shut, while the upper end 11 (FIGS. 9, 25) of the tube may include an outer rim 13 (FIGS. 9, 25) and then taper to a threaded collar 12 (FIGS. 9, 25) having an inner wall 14 (FIG. 9) defining a channel 16 (FIG. 9) through which the contents of the fluid reservoir may flow.

The collar 12 may nest in a lower end of a brush cap 22 which may have a housing with an upper portion for receiving the brush and a lower portion for forming the exterior of a valve. The lower portion may include a threaded inner portion 26 (FIG. 7) for receiving the collar 12 of the fluid reservoir 8. Disposed in the brush cap 22 may be a valve 30 configured to selectively prevent the passage of lotion, etc., out of the fluid reservoir 8 and through the brush cap 22. The brush cap 22 may include an indicator 28 which aligns with a word or symbol on the valve 30 to indicate whether the valve in an "on" position (FIG. 1) wherein fluid flow is allowed through the valve, and an "off" position (FIG. 8) wherein lotion cannot pass through the valve.

Figure 2:
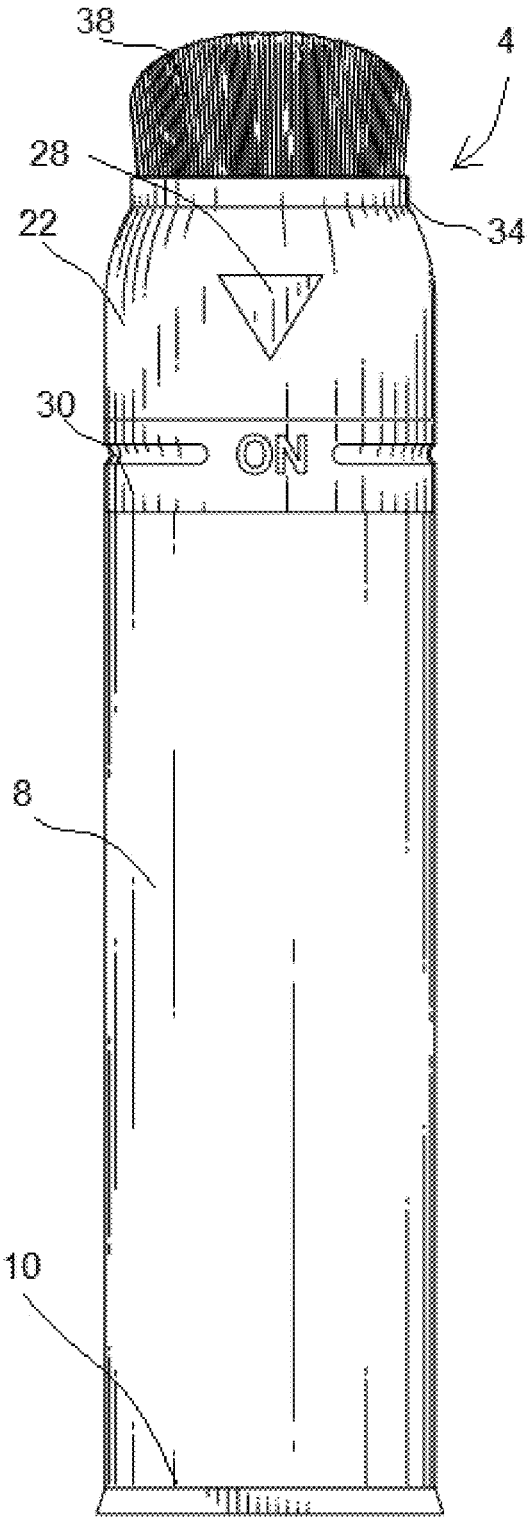
FIG. 2 shows a top view of the applicator in an on position.
Figure 8:
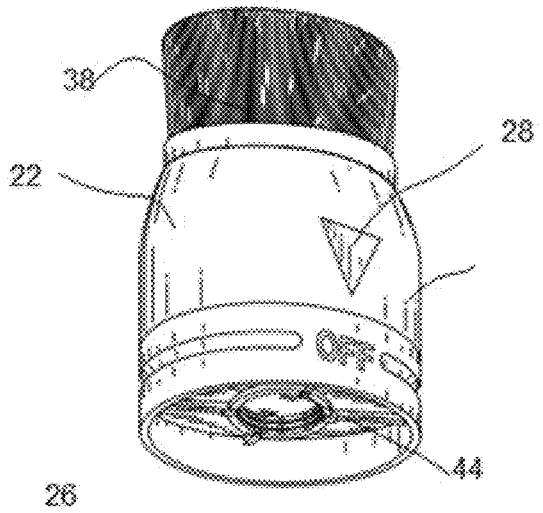
FIG. 8 shows another perspective view of the brush cap.

While shown in FIGS. 1, 2 and 8 as being a large downwardly pointing triangle, it will be appreciated that numerous other markers or indicators could be used to identify whether lotion or other fluids or liquids can be dispensed by applying pressure to the tube forming the fluid reservoir 8. It will be appreciated that the valve 30 may rotate relative to the remainder of the brush cap 22 or may be configured to rotate relative to the fluid reservoir 8.

Near a top of the upper portion of the brush cap 22 is an annular flange 34 which may be used to secure a brush 38. The annular flange may define a recess or depression into which the bottom end of the brush 38 is inserted and attached by adhesive, heat sealing or other known affixation methods. When the tube forming the fluid reservoir 8 is pressed while the valve 30 is in the "on" position, lotion, gel, or other fluid in the fluid reservoir can be squeezed out by placing pressure on the fluid reservoir. The lotion, gel etc. will pass through the valve 30 and into the brush 38 from which it may be applied to a desired surface, such as to the skin or to the clitoris, labium, or other anatomical structures. Thus, for example, the applicator 4 can be used to apply yeast infection medication or personal lubricant without requiring a woman to contact the interior of her genitals during application. If used over a period of time, a number of brush caps could be used so that bacteria or other microbes cannot build up on the brush 38.

Figure 3:
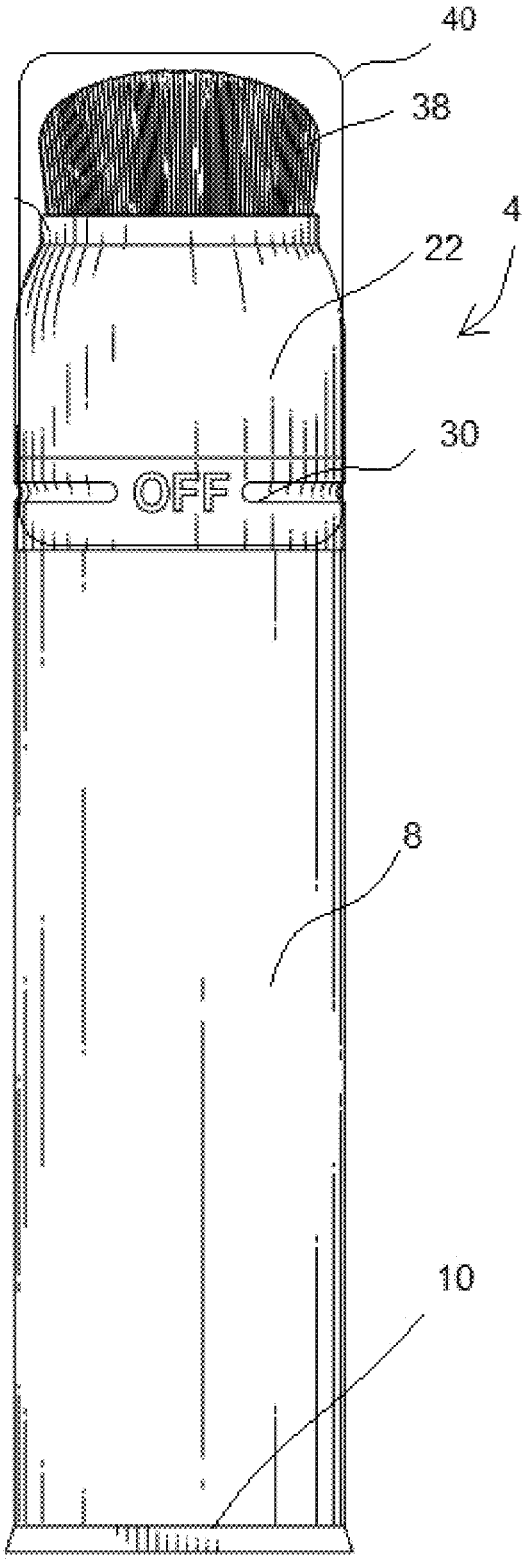
FIG. 3 shows a top view of the applicator in an off position.

Turning now to FIG. 2, there is shown a front view of the applicator 4 in the "on orientation so that lotion, gel, etc. can be dispensed from the fluid reservoir 8. As shown in FIG. 2, the brush 38 can be rounded broadly from side to side. FIG. 3 shows the backside view when the valve 30 is in the same orientation. Also shown is a top cap 40 which can be used to cover all or a portion of the brush cap 22 and protect the brush 38 when not in use.

Figure 4:
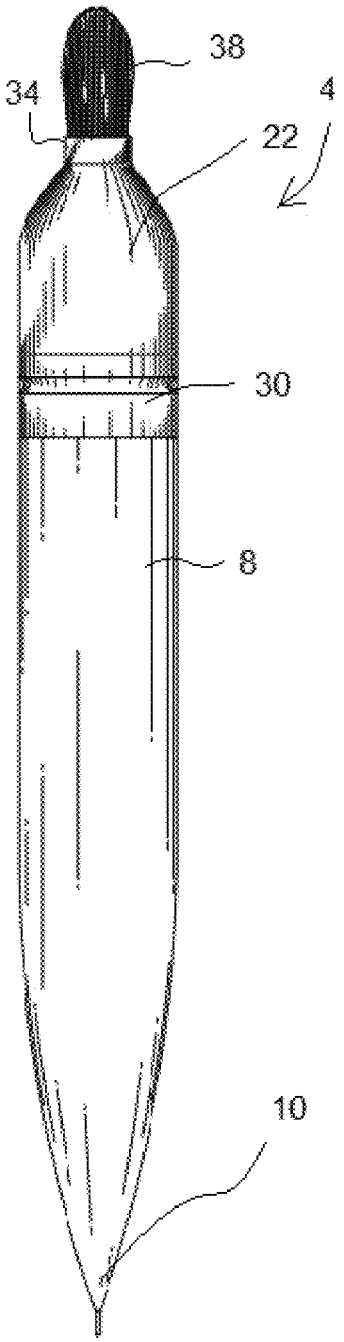
FIG. 4 shows a side view of the applicator.

FIG. 4 shows a side view of the applicator 4. The brush 38 is also rounded from front to back, thereby providing a shape which is particularly convenient to application of anti-fungal cream, anti-itch lotion and personal lubricant between the labia majora.

Figure 5:
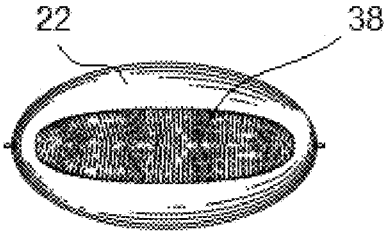
FIG. 5 shows a top view of the brush cap.
Figure 6:
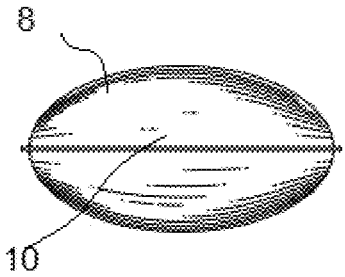
FIG. 6 shows a bottom view of the fluid reservoir.

FIG. 5 shows a top view of the applicator 4. The brush 38 and the brush cap 22 are visible, as are the corners of the bottom 10 of the fluid reservoir. FIG. 6 in contrast, shows the bottom end 10 of the fluid reservoir 8, which shields the other components.

Figure 7:
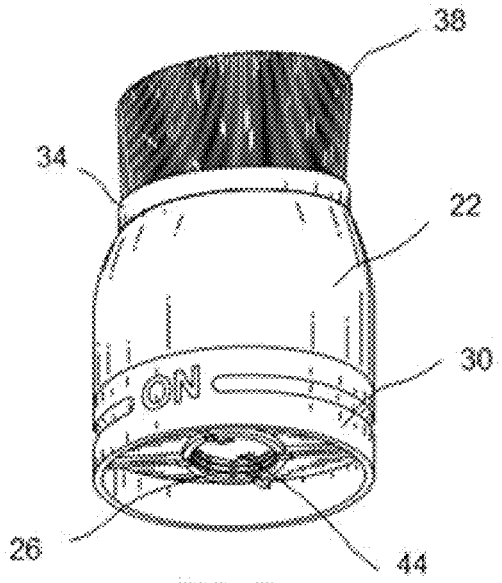
FIG. 7 shows a perspective view of brush cap separated from the fluid reservoir.
Figure 9:
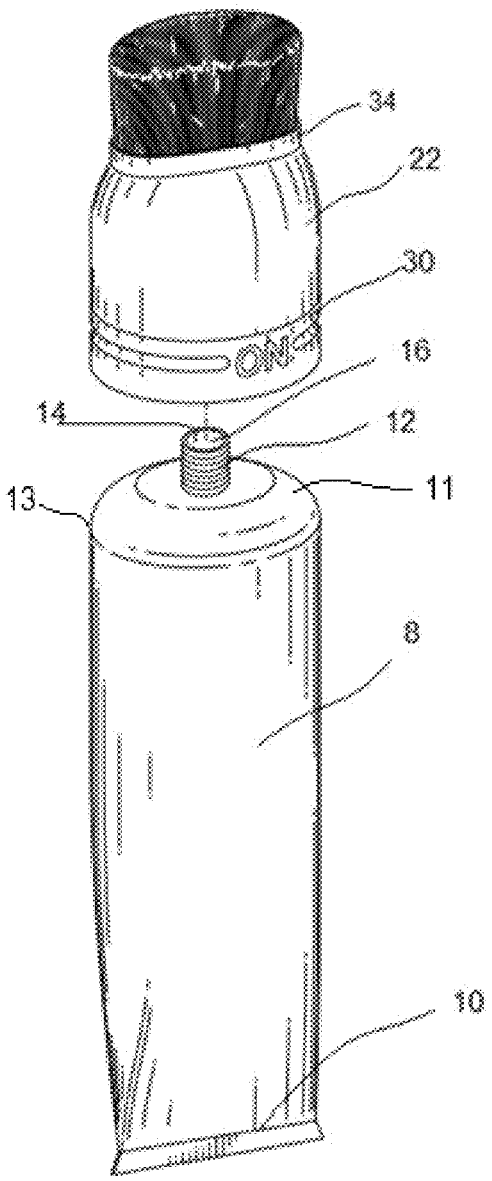
FIG. 9 shows a perspective exploded view of the applicator. side view of an alternate embodiment of the fluid reservoir.

FIG. 7 shows a perspective view of the brush cap 22, so as to show the annular flange 34 which receives the brush, and the valve 30. Disposed on a lower side of the valve 30 is the inner portion 26, which may be threaded or may have some other engagement mechanism for receiving and holding the collar 12 (FIG. 9) of the fluid reservoir 8 (FIG. 9). Disposed in the inner portion are one or more openings 44 which allow lotion, gel, etc. to pass through the valve 30 when in an open or on position and to be prevented from passing through the valve when in a closed or off position as shown in FIGS. 7 and 8 as shown by the alignment of the indicator 28 and the word "off" in FIG. 8.

Figure 10:
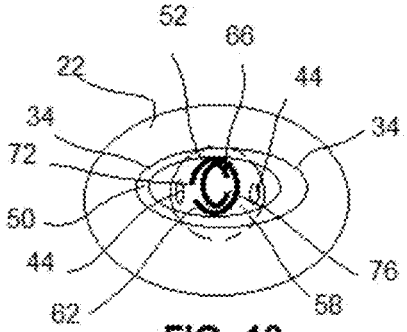
FIG. 10 shows top view of the housing of the brush cap with the brush removed in a closed configuration.

Turning now to FIG. 10, there is shown a top view of the brush cap 22 with the brush removed. The annular flange or collar 34 is disposed about a surface 50 for attaching the brush. Inside the surface 50 is a dispensing opening 52, which may be elongate, through which lotion, gel, etc., may pass to be pushed into the brush for application. It will be appreciated in light of the present disclosure that a more conventional round hole could be used, but doing so would lessen the ability to spread out the fluid for application with the brush.

Figure 11:
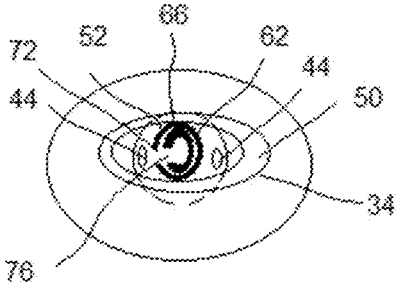
FIG. 11 shows a top view of the housing of the brush cap with the brush removed in an open configuration.

One or more intake openings 44 may be provided in a floor of the valve 30 which allows fluid to flow into a containment chamber 58. Two generally cylindrical walls 62 and 66 are disposed concentrically, with each having an opening 72 and 76, respectively. The interior of inner cylindrical wall 62 is disposed in communication with the opening 52 disposed adjacent the brush. When the walls 62 and 66 are rotated so that the openings 72 and 76 are out of alignment, as shown in FIG. 10, the fluid passing into the containment chamber 58 is contained therein and the valve 30 is in the closed or off position. However, then the walls are rotated so that the openings 72 and 76 are in alignment, as shown in FIG. 11, the lotion, gel, etc. is able to flow up through the center of the generally cylindrical wall 76 and into the brush. FIG. 11 shows a side view of the openings.

Figure 12:
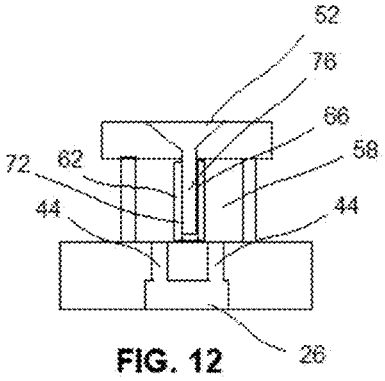
FIG. 12 shows a side view of the interior components of the valve.

FIG. 12 shows a side view of the internal working of the valve 30. The inner portion 26 leads to the openings 44 which lead into the containment chamber 58. When the openings 72 and 76 are in alignment, the lotion, gel, etc. in the containment chamber can flow through the cylindrical walls 62 and 66 and out the opening 52.

Figure 13:
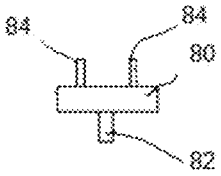
FIG. 13 shows a manifold which may be used to dispense fluid passing through the valve.

FIG. 13 shows a side view of a manifold 80 which can be used to direct the lotion, gel etc. to locations adjacent opposing ends of the brush. The fluid being distributed enters the inlet 82 and goes out of a plurality of outlets 84.

While discussed above with respect to women's care products, it will be appreciated that the applicator of the present disclose will have a wide variety of uses, especially where cross-contamination is a concern. For example, infants will often get diaper rash. The applicator of the present disclosure is particularly well suited for applying diaper rash medication without having the user's hands come into contact with the sores on the child's bottom. By squeezing on the fluid reservoir, the diaper rash cream is delivered to the brush (when in the on orientation) and the care giver can apply the cream directly to the sores without contaminating the sores with any bacteria or other microbes on the user's hands and without contaminating the user's hands with anything which may be present with the sores. If the cream is needed for a short period of time, a single brush cap could be used. Alternatively, the brush cap could be thrown away after a single use and replaced with a new one for each use.

The applicator may be used of a variety of other creams, liquids, lotions, and the like, such as anti-itch cream for someone who has come into contact with poison ivy or some other irritant, an anti-bacterial on a wound, or any number of other medicines, ointments, etc. where it is desirable to apply the material with minimal risk of cross-contamination.

Figure 14:
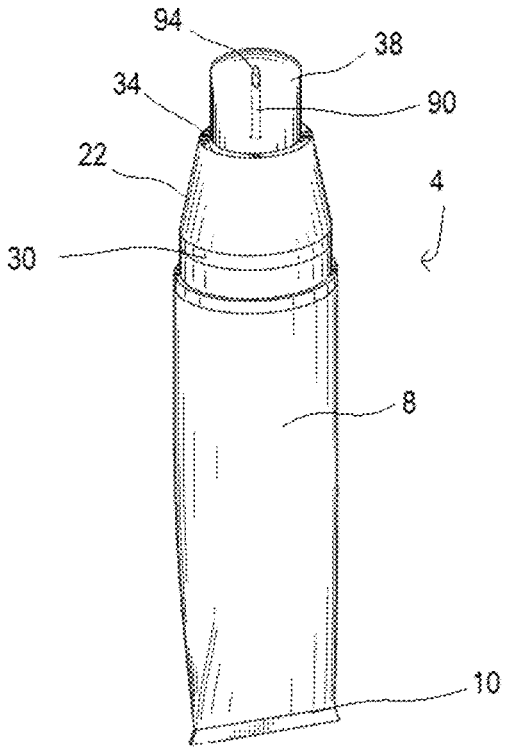
FIG. 14 shows perspective view of another applicator for applying flowable materials.

Turning now to FIG. 14, there is shown a perspective view of an applicator 4 formed in accordance with aspects of the present disclosure. The applicator 4 includes a fluid reservoir 8 having a closed lower end 10 and a brush cap 22 disposed on the opposing end. The brush cap 22 has a valve 30 for selectively allowing a flowable material through the brush cap. A brush 38 may be mounted on the brush cap 22 and may be held in place by an annular flange 34.

The brush 38 may be formed from a single piece of material rather than having numerous bristles. The material may be plastic, a polymer or silicone. In many applications it is desirable that the brush 38 is flexible so as to allow the brush to flex as the flowable material is applied to a user's skin or to any other substrate.

The brush 38 may include one or more channels 90 extending therethrough, which may terminate in one or more openings 94 which are in fluid communication with the channel. When the valve 30 is in an open position, squeezing the housing defining the fluid reservoir pushes flowable material out through the channel(s) 90 and through the opening(s) 94 so that it may be applied by the brush 38. The single piece brush 38 allows for a smooth application of the flowable material. It also allows for easy reuse of the applicator. While leaving of creams, ointments and other materials between the bristles of a brush may results in the brush becoming dirty, smelly and hard over time, the single piece brush allows the brush to be easily cleaned after each use. Once the cream, ointment, etc. has been applied, the brush 38 can be cleaned with a baby wipe, paper towel or sanitizing wipe to remove any excess cream, ointment, etc., and to sanitize the brush if desired. In such a manner, a tube of ointment can be used to directly apply such flowable material without the risk of contamination, without the requirement that the user washes their hands, and without the brush being fouled by the ointment, etc.

Figure 15:
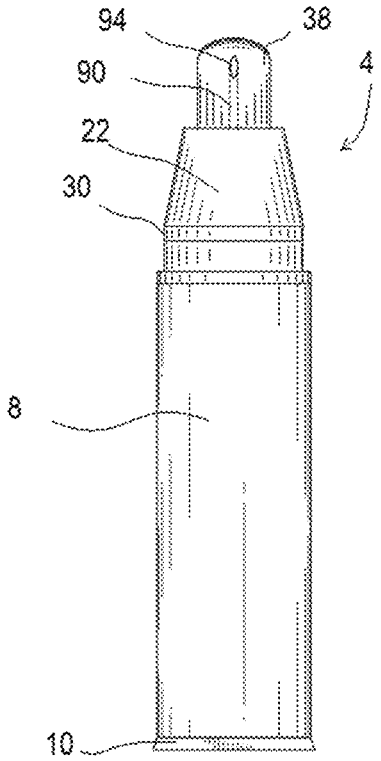
FIG. 15 shows a front view of the applicator of FIG. 14.
Figure 16:
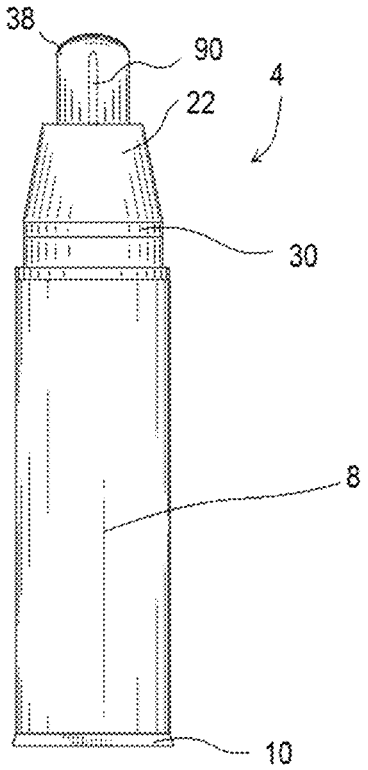
FIG. 16 shows a back view of the applicator of FIG. 14.

FIGS. 15 and 16 show front and rear views, respectively, of the applicator 4 of FIG. 14. The applicator 4 is shown in a closed position wherein the valve 30 prevents flowable material from inside the fluid reservoir 10 from passing to the brush 38.

Figure 17:
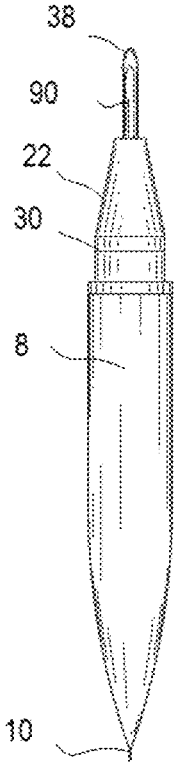
FIG. 17 shows a side view of the applicator of FIG. 14.

Turning now to FIG. 17, there is shown a side view of the applicator of FIG. 14. The valve 30 is in a closed position as will be discussed in additional detail below. The fluid reservoir 8 has a closed lower end 10 and a brush cap 22 disposed on an upper end. The brush 38 with a channel 90 formed therein is also shown. The opening at the end of the channel 90 is not visible in the view.

Figure 18:
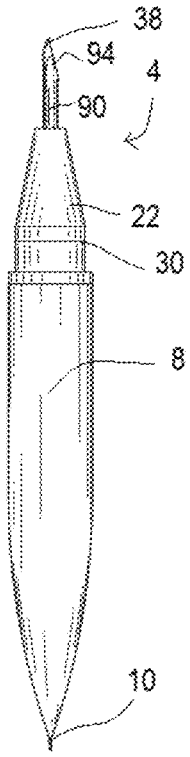
FIG. 18 shows a side view of another applicator.

FIG. 18, in contrast, shows a brush which is flattened along one side so that the opening 94 is visible at the edge. It will be appreciated that the brush may be formed in various configurations depending on the particular flowable material and the substrate to which it is likely to be applied. For example, when applying paint to a wall to cover a scuff mark, a thumbtack hole or to repair some other blemish, it may be desirable to have a generally flat surface on the brush 38 which acts to spread and smooth the paint on a flat surface, such as to a wall, and thereby allow the paint to be applied evenly. It will be appreciated that the size of the brush 38 may be adapted to the intended use. Thus, for example, a contractor or homeowner may obtain an applicator 4 which is 0.25 inches wide if the purpose of the brush is to cover nail holes on a room being remodeled. Alternatively, a contractor or homeowner may obtain an applicator with a brush 38 which is between 0.5 and 1.5 inches wide if the paint will be used for general touch-ups around a house. Alternatively, a homeowner may obtain an applicator which is 3 inches wide to facilitate applying paint along the edge of a wall so that a roller can be used on the remainder of the wall without having to approach the adjoining wall, ceiling or floor too closely and inadvertently get paint on the adjoining wall etc. Thus, applicators 4 can be sold varying brush sizes, such as 0.25, 0.5, 1.0, 1.5-, 2.0-, 2.5- and 3-inch widths—thereby allowing the user to pick the brush which best works for their application. The applicator 4 could even be sold in much larger sizes, such as 5 inches or 6 inches wide depending on the application to which the applicator will be used.

Because the paint is dispensed by squeezing on the fluid reservoir 8 and the applicator 4 has a closeable valve 30, the paint in the fluid reservoir is not exposed to air and thus does not cross-link or dry like paint left in a can. When the painting is done, the paint on the brush 38 and in the channel 90 can be removed by dipping the brush 34 into paint thinner. This requires considerably less paint thinner than a conventional paint brush and can remove the paint better because the paint is not held within bristles. Thus, fewer paint brushes will be discarded, and less paint thinner is used, both helping the environment.

Figure 19:
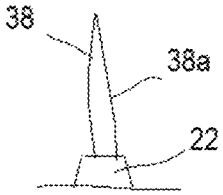
FIG. 19 shows a fragmented side view of a brush of an applicator.

Thus, as shown in FIG. 19, the brush 38 may include a face 38*a* which can be used to apply the flowable material. In FIG. 19, the face 38*a* is substantially flat so that it may be used to apply a smooth coat of paint, stain or other material to a substrate. Such an applicator is desirable where the flowable material is preferentially evenly spread on the substrate which is generally flat.

Figure 20:
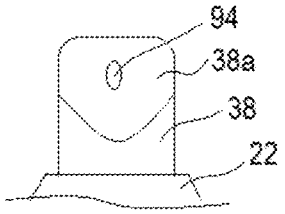
FIG. 20 shows a fragmented front view of a brush of an applicator.

In contrast, the brush 38 in FIG. 20 has a face 38*a,* at least a portion of which may be concave. Having a concave face 38*a* may provide benefits when applying a variety of flowable materials to convex surfaces. For example, an anti-fungal cream or nail polish may be applied with a brush 38 having a concave face which generally matches that the curvature of fingernails. Likewise, an applicator may have a brush 38 with a face 38*a* which is contoured to match the curvature of eyelids for applying an under-eye cream or serum to be applied to the upper eyelid.

Figure 21:
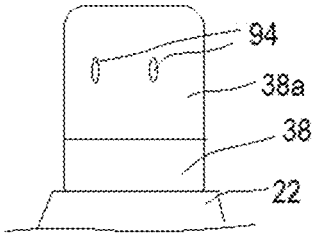
FIG. 21 shows a fragmented front view of another brush of an applicator.

FIG. 21 shows a brush 38 attached to a brush cap 22 in which the brush has a generally flat face 38*b*. The brush 38 is wider than the brush in FIG. 22, and thus may include a plurality of holes 94 for releasing the flowable material. The number and size of the holes may depend, in part, on the width or length of the brush, as well as the viscosity of the flowable material. Thus, flowable materials which have very low viscosity may require only 1 small hole, while a more viscous flowable material may require the use of 2 or 3 larger holes for the same sized brush. The holes may be disposed in a straight line across the brush or may be offset to provide adequate support within the brush so that the brush cannot be easily torn or damaged in the area of the openings.

Those who sell the flowable materials can design the brush 38 in accordance with the likely use and flowability of their product. For example, the 3-inch-wide brush may have 3 holes evenly spaced across the brush, or may rely on a single hole due to the viscosity and spreadibility of their product.

Figure 22:
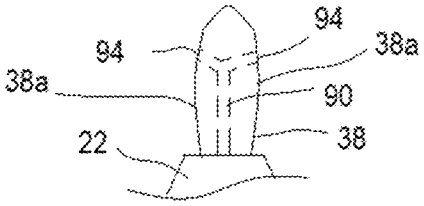
FIG. 22 shows a side view of another brush of an applicator.

Turning now to FIG. 22, there is shown a brush 38 which has 2 faces 38*a* on opposing sides of the brush. Additionally, the channel 90 is provided with two or more openings 94 so that a flowable material may be applied to both faces. Such a brush 38 would be useful for purposes where it is desirable to apply a flowable material to both sides of a structure. For example, above there is discussed the application of vaginal creams, such as those used for yeast infections, and personal lubricants. The brush 38 could be used to apply such flowable materials with a single pass. Once finished, a baby wipe or sanitary wipe can be used to wipe off the brush 38, thereby leaving it clear for the next application.

Figure 23:
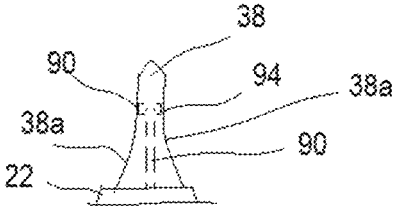
FIG. 23 shows a side view of another brush of an applicator.

While FIG. 22 shows a brush 24 having two convex faces 38*b,* it will be appreciated that a brush 38 may have 2 convex faces 38*a,* such as may easily be places between the gluteus maximus of a child for suffering from diaper rash as is shown in FIG. 23. Each of the convex faces 38*a* may have an opening 94 so that flowable material passing through the brush cap 22 and the channel 90 are dispensed on both sides of the brush 38.

Figure 24:
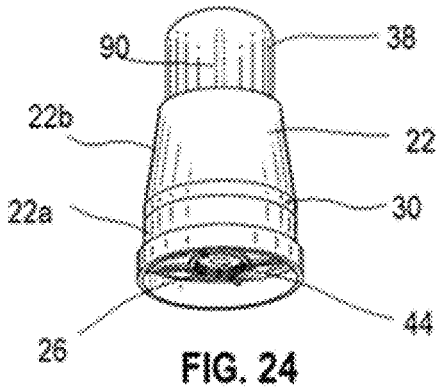
FIG. 24 shows a lower perspective view of a brush cap.
Figure 25:
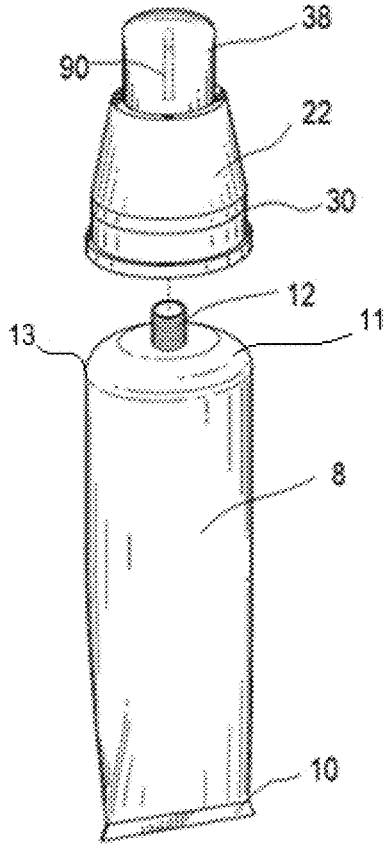
FIG. 25 shows an exploded view of the reservoir and the brush cap.

FIG. 24 shows a lower rear perspective view of a brush cap 22. The brush cap may have a lower portion 22*a* and an upper portion 22*b* which are connected to one another as to form the valve 30. The lower portion 22*a* may include a threaded collar 26 for receiving a threaded collar 12 on the fluid reservoir (FIG. 25). The lower portion 22*a* may also have one or more openings through which a flowable material in the fluid reservoir 8 (FIG. 25) can flow out through the brush cap 22 and through the brush 38.

FIG. 25 shows an exploded view of the fluid reservoir 8 and the brush cap 22, thereby exposing the threaded collar 12. It will be appreciated that the brush cap 22 can be attached to the fluid reservoir 8 by other than a threaded engagement between the threaded collar 12 on the fluid reservoir and the threaded collar 26 on the brush cap. For example, the fluid reservoir could be glued, thermally welded, etc. to the brush cap.

Figure 26:
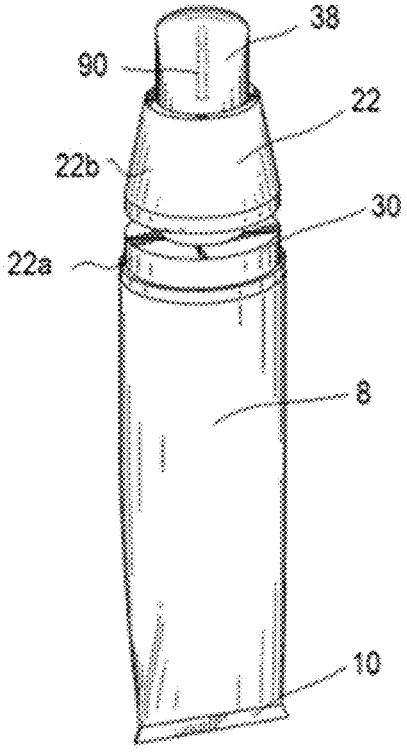
FIG. 26 shows a perspective view of an applicator disposed with the valve in an open position.

FIG. 26 shows a perspective view of an applicator disposed with the valve in an open position. This may be accomplished by rotating the lower portion 22*a* and the upper portion 22*b* of the brush cap 22 relative to one another. In the embodiment shown in FIG. 26, this causes the upper portion 22*a* to move away from the lower portion and open a flow path through which the flowable material in the fluid reservoir can pass through the brush cap 22 and through the channel 90 in the brush 38. While the channel 90 in the brush is generally formed by a lumen, it will be appreciated that there may be applications in which an open channel may be desired for all or part of the channel's length.

Figure 27:
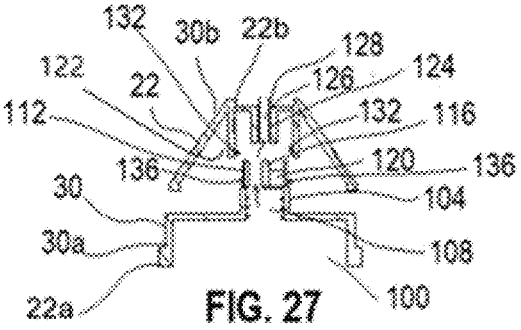
FIG. 27 shows a cross-sectional view of the valve in the open position.

FIG. 27 shows an exploded cross-sectional view of the valve 30. The valve 30 may include a lower portion 30*a* and an upper portion 30*b*, the valve 30 being formed by the lower portion 22*a* and the upper portion 22*b* of the brush cap 22. It will be appreciated that the interacting components discussed below may be reversed so that structures shown in the lower portion 30*a* of the valve 30 may be disposed in the upper portion 30*b* and the structures formed in the upper portion may be disposed in the lower portion.

The lower portion 30*a* may include an annular or ovular or circular flange 101 which extends downwardly from a periphery of a lower surface 102 of the lower portion to at a width of the fluid reservoir 8 (e.g. FIG. 29) to form a recess 100 for receiving the upper end of a fluid reservoir. A threaded collar which extends from (e.g. collar 26 shown in FIG. 24) or extends into (e.g. collar 104 shown in FIG. 27) the lower surface of the lower portion 30*a* facilitates attachment of the fluid reservoir. As mentioned previously, the fluid reservoir can also be attached to the lower portion 22*a* of the brush cap 22 by other means in addition to or alternatively to a threaded engagement. The lower portion 30*a* of the valve 30 may include one or more generally cylindrical walls, such as the lower collar 104 which may be threaded and which, if present, may form part of a fluid flow path 108. Another cylindrical wall, such as an upper collar 112, may also form one or more fluid flow paths and may have a projection 116 extending therefrom. The projection 116 may be held to the collar by one or more walls 120 extending between the projection and the upper collar 112. In one application three walls 120 are used with only one being drawn in the cross-sectional view for clarity. When the fluid reservoir 8 (FIG. 26) is squeezed, the flowable material contained therein will attempt to flow through the upper collar.

Disposed on the upper portion 30*b* of the valve may be a mating outer collar 122 which fits around the upper collar 112 on the lower portion 30*a*. The outer collar 122 may have projections or threads 132 which engage projections or threads 136 on the upper collar 112 so that rotation of the upper portion 30*b* moves the upper portion toward or away from the lower portion 30*a*. The upper portion may also include an inner collar 124 through which a flow lumen 126 is provided with an opening 128 disposed on top. When the valve 30 is rotated into an open position, flowable material within the flow reservoir 8 (FIG. 25) will flow through the upper collar 112 and the flow lumen in the inner collar 124 and through the opening 128 into the lumen or channel in the brush (not shown). When the upper portion 22*b* of the brush cap 22 (i.e., the upper portion 30*b* of the valve 30) is rotated so that the upper portion is pulled toward the lower portion 22*a*, the projection 116 nests inside the lower end of the flow lumen 126, blocking the flow therethrough.

Figure 28:
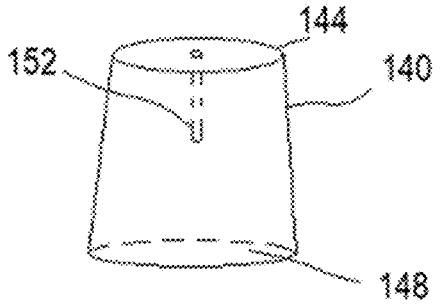
FIG. 28 shows a brush cap cover which may be used in accordance with aspects of the present disclosure.

FIG. 28 shows a brush cap cover 140. The brush cap cover 140 may include a body 142 having a first, closed end 144 and a second, open end 148 extending from the first, closed end 144 may be a projection 152 which is sized to fit into the opening 94 (FIG. 26) in the brush 38 (FIG. 26) and a short distance down the lumen or channel 90. In such a manner the projection 152 keeps the contents of the lumen from being exposed to the air, which may cause the flowable material to dry out. While a small amount of the flowable material may be displaced by the projection 152, the projection and or the brush 38 may be made from a material two which the flowable materials will not readily stick. Thus, the brush 38 and the projection 152 may be wiped off to remove any trace amounts of the flowable material which may have dried thereon. In such a manner the contents of the fluid reservoir 8 (FIG. 26) can be kept fresh for an extended period of time which may be used in accordance with aspects of the present disclosure.

Figure 29:
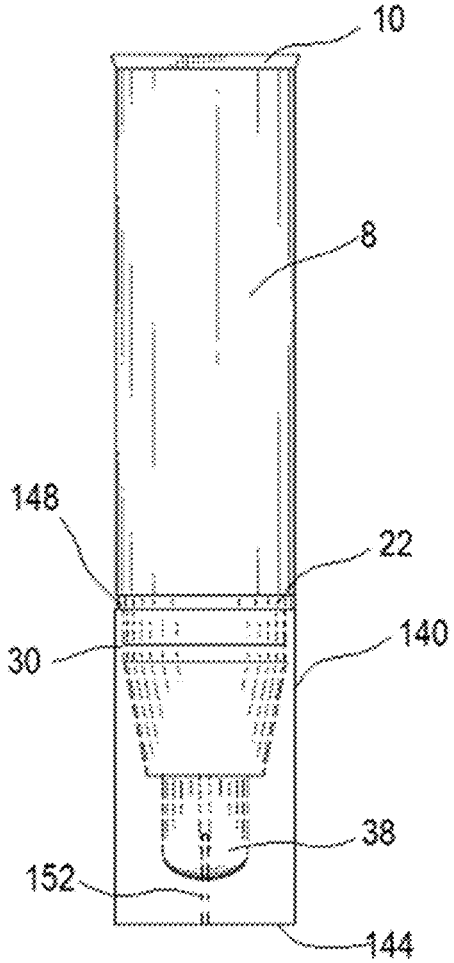
FIG. 29 shows front view of the applicator being stored in a vertical orientation with the cover being disposed on the brush.

FIG. 29 shows a front view of the applicator 4 being stored in a vertical orientation. The brush cap cover 140 may have a generally flat first, closed end 144 so that the cover may be positioned with the second, open end 148 on top so that the applicator 4 may be held with the brush 38 pointed down. Such an orientation is advantageous for reducing the footprint of the applicator 4 while being stored. It is particularly helpful when the fluid reservoir 8 contains condiments, such as barbeque sauce, katsup, salad dressing, oil, or the like. It also makes storage more convenient for paint, personal care creams and ointments and other flowable material.

Figure 30:
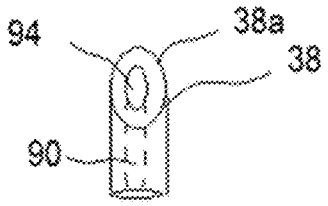
FIG. 30 shows a front view of a brush in accordance with the present disclosure.

It will be appreciated that multiple brush configurations can be used in conjunction with an applicator. FIG. 30 shows a bush 38 which is generally cylindrical, and which has a beveled or sloped face 38*a* with the opening 94 formed therein. Such a brush configuration may be beneficial for lip gloss, applying a liquid bandage fluid, applying anti-wart or anti-blemish compounds, applying anti-itch medication to a mosquito bite or other bug bite, applying anti-acne cream or any other flowable material which the user wishes to apply to a small area without getting the flowable material and adjacent substrate.

Figure 31:
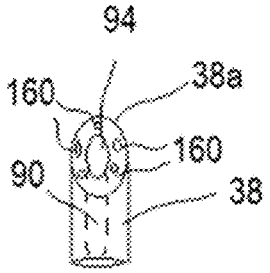
FIG. 31 shows a bush which may be used in accordance with the present disclosure.
Figure 32:
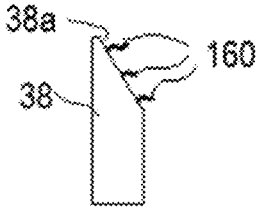
FIG. 32 shows side view of the brush of FIG. 31.

FIG. 31 shows a brush 38 which is similar to that shown in FIG. 30, except that the face 38*a*, about the opening 94, may have a plurality of projections 160. Depending on the size and material of the projections, the projections may be used for massaging the skin or from roughening an area to which the flowable material may be applied. The projections 160 may be between 0.004 and 0.04 inches (0.1 mm to 1 mm) in diameter and between 0.004 to 0.12 inches (0.1 mm to 3 mm) in length. FIG. 32 shows a side view of the brush 38 of FIG. 31.

Figure 33:
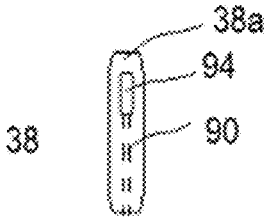
FIG. 33 shows a brush which may be used in accordance with the present disclosure.
Figure 34:
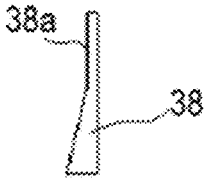
FIG. 34 shows a side view of the brush of FIG. 33.

FIGS. 33 and 34 show front and side views respectively, of another brush 38. The brush 38 is very thin and enables the portion with the face 38*a* to bend easily, allowing the brush to be inserted into the small spaces, such as may be useful to applying a lubricant (liquid or powder) to a bolt or other structure, or to apply flowable materials to areas of the skin which may be very fragile, such as applying ointment to burned skin.

Thus, there is disclosed a new applicator and method of using the same. It will be appreciated that numerous modifications may be made without departing from the scope and spirit of the invention. The appended claims are intended to cover such modifications.

What is claimed is:

1. An applicator comprising:

a reservoir for holding a flowable material, the reservoir having a collar, the reservoir having an upper end having an outer rim;

a brush cap selectively attached to the reservoir on the collar of the reservoir, the brush cap having an upper portion and a lower portion which may be rotated relative to one another to thereby form a valve to selectively allow flowable material to flow through the brush cap, the lower portion of the brush cap having a lower surface and a flange extending downwardly from a periphery of the lower surface for forming a recess for receiving the upper end of the reservoir such that the flange extends to the outer rim of the upper end of the reservoir, a first internally threaded collar for receiving the collar of the reservoir, and a second, upper collar having a flow path therethrough, and wherein the upper portion of the brush cap has a first collar with a flow path therethrough, and wherein one of the second, upper collar on the lower portion of the brush cap and the first collar on the upper portion of the brush cap has a projection disposed thereon such that moving the lower portion of the brush cap and the upper portion of the brush cap toward each other causes the projection to extend into the flow path of the other collar and inhibit flow through the flow path; and a brush attached to the brush cap, the brush having a channel formed therein for carrying flowable material within the brush.

2. The applicator of claim 1, wherein the upper portion of the brush cap further comprises a second collar, the second collar being threaded and disposed around the first collar on the upper portion.

3. The applicator of claim 2, wherein the upper collar on the lower portion is threaded and threadedly engages the second collar on the upper portion.

4. The applicator of claim 1, wherein the upper collar on the lower portion has the projection mounted within the upper collar and wherein rotation of the upper portion and the lower portion relative to one another brings the first collar on the upper portion down onto the projection to thereby prevent the flow of flowable material therethrough.

5. The applicator of claim 1, wherein the brush is formed from a single piece of material.

6. The applicator of claim 5, wherein the brush is formed from flexible polymer.

7. The applicator of claim 5, wherein the brush is formed from silicone.

8. An applicator comprising:

a reservoir for holding a flowable material, the reservoir having an upper end with an outer rim;

a brush for applying the flowable material; and a brush cap attached to the brush and being selectively attachable to the reservoir, the brush cap comprising a valve for regulating the flow of flowable material through the brush cap between the reservoir and the brush, wherein the brush cap includes an upper portion attached to the brush and a separate lower portion rotatable with respect to the upper portion, the lower portion having a first collar with a flow path therethrough and the upper portion having a second collar with a flow path there through, and wherein one of the second collar of the upper portion and the first collar of the lower portion has a wall extending inwardly from the collar and a projection disposed on the wall and wherein rotating the upper portion of the brush cap in one direction causes the projection to move into the flow path of the other collar to thereby prevent flow through the other collar, and wherein the lower portion has a lower surface having an ovular or circular flange extending downwardly therefrom so to as to form a recess for receiving the upper end of the reservoir, the ovular or circular flange extending to the outer rim of the reservoir.

9. The applicator of claim 8, wherein the brush cap further comprises a third collar formed in the upper portion of the brush cap, the third collar having an open bottom and being threaded on an inside of the third collar, and wherein the first collar is threaded on an outside of the first collar, the projection being disposed in the first collar and wherein rotating the third collar relative to the first collar causes the projection to advance into or retract from the flow path through the second collar on the upper portion of the brush cap.

10. The applicator of claim 9, wherein the brush is formed of a single piece of material.

11. The applicator of claim 10, wherein the brush has a channel extending therethrough for passing flowable material.

12. The applicator of claim 11, wherein the brush includes as least one face and wherein the at least one face has an opening formed therein, the opening being disposed in fluid communication with the channel.

13. The applicator of claim 10, wherein the brush is formed from a flexible polymer.

14. The applicator of claim 10, wherein the brush is formed from a piece of silicone.

15. The applicator of claim 8, wherein the lower portion of the brush cap comprises a cylindrical wall for receiving the reservoir.

16. The applicator of claim 15, wherein the cylindrical wall forms a collar.

17. The applicator of claim 8, wherein the collar in the lower portion has the projection disposed in alignment with the flow path in the collar in the upper potion and wherein rotating the upper portion of the brush cap in one direction causes the projection to stick into the flow path and rotating the upper portion in an opposing direction moves the projection out of the flow path.

18. The applicator of claim 8 wherein the brush has a brush face which is planar.

19. The applicator of claim 8, wherein the brush has a brush face which is concave.

20. The applicator of claim 8, wherein the brush has a brush face which is convex.

21. An applicator comprising:

a brush a brush cap the brush cap having two separate pieces, one piece forming an upper portion, the upper portion having an inner collar with a flow lumen therethrough and projections or threads on the inner collar, and a second piece forming lower portion with a collar having a flow path therethrough and projections or threads thereon so as to engage the projections or threads of the inner collar of the upper portion so as to move the upper portion and the lower portion toward and away from each other depending on a direction which the upper portion and the lower portion are rotated with respect to each other, the lower portion further comprising a second collar which is threaded; and a reservoir having a threaded collar for selectively attaching the reservoir to the lower portion of the brush cap.

* * * * *